United States Patent [19]

Marx

[11] Patent Number: 5,067,402

[45] Date of Patent: Nov. 26, 1991

[54] APPARATUS FOR THE PREVENTION OF PRINTING MACHINE DAMAGE

[75] Inventor: Helmut H. Marx, Wurzburg, Fed. Rep. of Germany

[73] Assignee: Koenig & Bauer Aktiengesellschaft, Wurzburg, Fed. Rep. of Germany

[21] Appl. No.: 614,119

[22] Filed: Nov. 16, 1990

[30] Foreign Application Priority Data

Nov. 20, 1989 [DE] Fed. Rep. of Germany ..... 3938478

[51] Int. Cl.[5] ..... B65H 26/02

[52] U.S. Cl. ..... 101/226; 226/11; 242/56 R

[58] Field of Search ..... 101/224, 225, 226, 227, 101/228; 226/11; 83/60, 64, 858; 242/56 R; 400/621

[56] References Cited

U.S. PATENT DOCUMENTS

| | | | |
|---|---|---|---|
| 2,653,536 | 9/1953 | Cooksey | 101/180 |
| 3,404,627 | 10/1968 | Halley | 226/11 |
| 4,014,260 | 3/1977 | Schroter-Dommes et al. | 101/212 |
| 4,765,240 | 8/1988 | Kraus et al. | 101/216 |
| 4,870,900 | 10/1989 | Robertson | 101/216 |
| 4,887,532 | 12/1989 | Kotterer | 101/225 |
| 4,905,596 | 3/1990 | Kobler | 101/216 |

FOREIGN PATENT DOCUMENTS

| | | |
|---|---|---|
| 1132563 | 7/1962 | Fed. Rep. of Germany . |
| 3142089 | 10/1981 | Fed. Rep. of Germany . |
| 0318853 | 2/1987 | Fed. Rep. of Germany . |

*Primary Examiner*—David A. Wiecking
*Assistant Examiner*—Stephen R. Funk
*Attorney, Agent, or Firm*—Jones, Tullar & Cooper

[57] ABSTRACT

A paper web which has become tensionless downstream of a printing unit is severed and thus prevented from wrapping up on a printing unit cylinder by the placement of one or more web dividing or cutting blades generally adjacent to the surface of the cylinder about which the paper web will tend to wrap.

3 Claims, 2 Drawing Sheets

APPARATUS FOR THE PREVENTION OF PRINTING MACHINE DAMAGE

FIELD OF THE INVENTION

The present invention is directed generally to an apparatus for the prevention of printing machine damage. More particularly, the present invention is directed to an apparatus for the prevention of printing machine damage in case of a paper web break. Most specifically, the present invention is directed to an apparatus for the prevention of paper web wind-up on a rotating cylinder in a printing machine in case of a paper web break. This damage is prevented by the placement of paper web severing knives adjacent the cylinders. These knives prevent that portion of a paper web upstream of a web break from adhering to the last roller in the path of web travel and from winding up on that last roller.

DESCRIPTION OF THE PRIOR ART

Paper web dividing devices are generally known in the prior art. These devices typically include sensing devices and paper web severing assemblies. In case of a break or a tear in the paper web being processed, these prior art devices operate to sever the web and to handle the newly created leading edge of the paper web.

In European patent application No. 0318853 there is shown a paper web dividing device which operates to cut off the paper web which has already been transported through the printing unit in case of a web break. This is accomplished by leading the paper web through a passage slit in the dividing device. Two spaced dividing knives or clamping jaws, which are opposed to each other, are arranged in this passage slit and these two dividing knives or clamping jaws can be moved together. Operation of these knives or clamping jaws is effected in response to the sensing of a web break or deflection by suitable web break switches. When these web break sensors detect a web break, they actuate suitable operating means for the web dividing knives or clamping jaws.

In devices of the type shown in this European patent application No. 0318853, the web break detection switch may react to a web deflection instead of a web break. This may cause severing of the web when there is no web break. Thus a web deflection not caused by a preceding web break may, in the prior art devices, still operate to cause the web to be severed.

Another disadvantage of prior art devices is that the web severing means, which reacts to a web break, may require a 15 substantial amount of operating space and may thus be located at a significant distance from the paper web printing rollers. When the web is broken, that portion of the web which remains upstream, in the direction of web travel of the break, may become wound up on the printing rollers or cylinders and may thus cause damage to the printing machine.

SUMMARY OF THE INVENTION

It is an object of the present invention to provide an apparatus for the prevention of printing machine damage.

Another object of the present invention is to provide an apparatus for the prevention of printing machine damage in the case of a paper web break.

A further object of the present invention is to provide an apparatus for the prevention of paper web wind-up on a rotating cylinder of a printing machine.

Yet another object of the present invention is to provide an apparatus for preventing a web which has already been led through a processing station having rotating cylinders from being pulled back into the processing station.

Even a further object of the present invention is to provide an apparatus for the prevention of printing machine damage which uses at least one stationary knife.

As will be discussed in detail in the description of the preferred embodiment, which is set forth subsequently, the apparatus for the prevention of printing machine damage in accordance with the present invention utilizes at least one stationary knife or cutting blade that is positioned adjacent the last cylinder of a printing unit which has contact with a paper web being printed. If the paper web that has been printed by the printing machine experiences a web break or tear at a location downstream, in the direction of web travel, of this last roller of the web printing unit, the stationary knife blade or blades will prevent the printed web from being wrapped up on the last roller. This means that this section of printed web will not be pulled back into the last printing unit.

The apparatus for the prevention of printing machine damage in accordance with the present invention is simple, inexpensive and durable. It has no moving elements and does not require any scanning devices or the like. In addition, the cutting knife or knives of the present invention can be installed in an area which is not readily accessible to the printing machinery operating personnel. This reduces the danger of injuries and thus provides improved and safer working conditions.

It will be seen that the apparatus for the prevention of printing machine damage in accordance with the present invention is superior to prior art devices and is a significant advance in the art.

BRIEF DESCRIPTION OF THE DRAWINGS

While the novel features of the apparatus for the prevention of printing machine damage in accordance with the present invention are set forth with particularity in the appended claims, a full and complete understanding of the invention may be had by referring to the description of the preferred embodiment, which is set forth subsequently, and as illustrated in the accompanying drawings in which:

DESCRIPTION OF THE PREFERRED EMBODIMENTS

Figure 1:
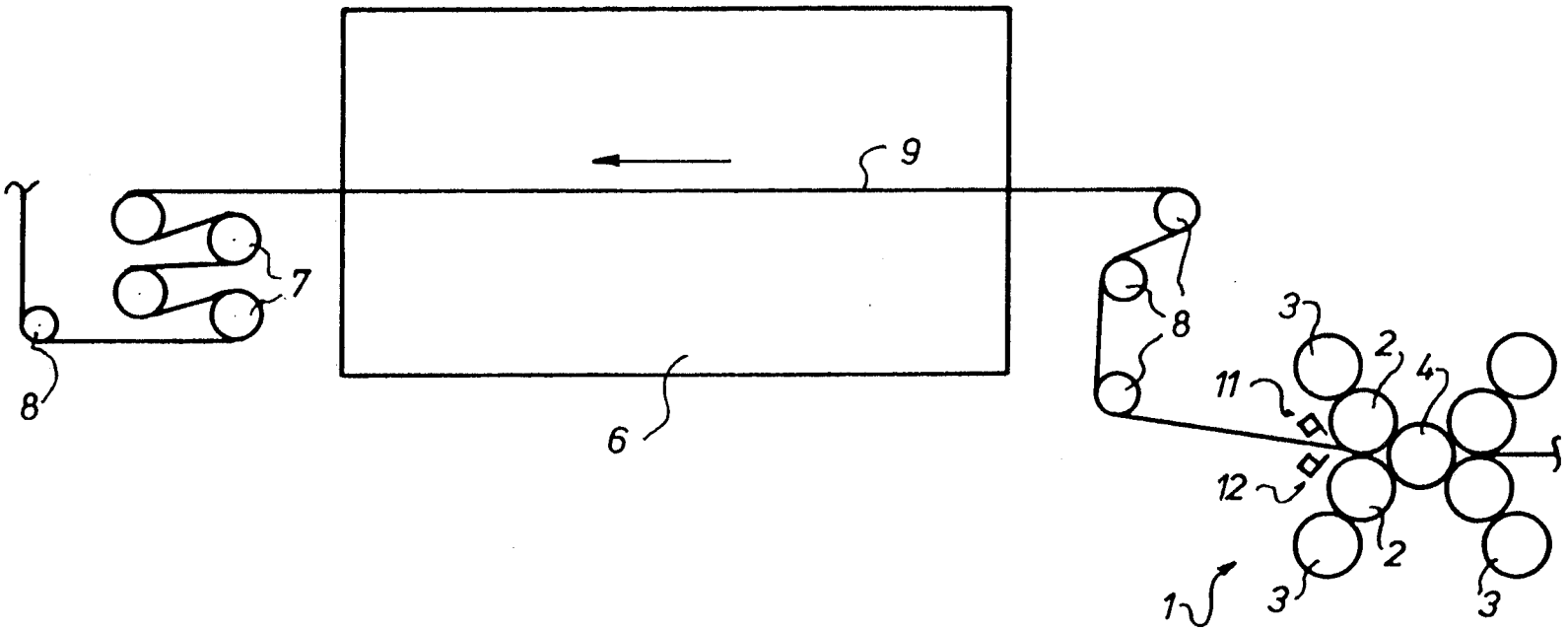
FIG. 1 is a schematic side elevation view of an exit portion of a printing machine and showing the installation location of the present invention.

Referring initially to FIG. 1, there may be seen generally at 1 a printing unit which utilizes the apparatus for the prevention of printing machine damage in accordance with the present invention. Printing unit 1 is schematically depicted and includes several spaced blanket cylinders 2 which cooperate with spaced plate cylinders 3 and an impression cylinder 4 to print a web of paper 9 that is passing through the printing unit 1. It will be understood that the apparatus of the present invention is most advantageously utilized with a printing unit 1 which is the last printing unit in the direction of web travel.

As may also be seen in FIG. 1, a dryer 6 is provided in the web fed rotary printing machine and is located downstream, in the direction of travel of web 9, from the last printing unit 1. This dryer 6 receives the printed web 9 after it has passed around several upstream web guide rollers 8. In the dryer 6, the printed web is typically subjected to an increased temperature and is then fed over spaced chill rollers 7 and a downstream web guide roller 8. The ink, and any other fluids which may have been applied to paper web 9 in the printing unit I are dried in the web dryer 6.

The paper web 9 which is passing through the dryer 6 is often apt to break or tear in the dryer 6 due to the imposition thereon of strong strains which are apt to be caused by thermal tensions. When the paper web 9 breaks in the dryer 6, the portion of web 9 upstream of the break, i.e., between the break and the last roller or rollers 2 of the last printing unit 1, loses its tension. This now tensionless web 9 is quite apt to stick to the surface of the last cylinder unit or the last blanket cylinder 2 with which it is in contact. This is due to the strong adhesive forces between the paper web 9 and the fresh ink applied to it by blanket cylinder 2. The length of the paper web 9 between the break point in the dryer 6 and the last blanket cylinder 2 may be as great as 20 meters or more. The pulling back and winding up of this amount of paper web on the last blanket cylinder 2 can lead both to a long standstill period for the printing machine and to costly and serious damages to the printing machine or unit 1.

In accordance with the present invention, one or more web dividing devices, generally at 11 and 12 in FIG. 1, may be placed adjacent the last cylinder o cylinders 2 of the last printing unit 1. While there are two such web dividing devices 11 and 12 depicted in FIGS. 1 and 2, it will be understood that if there was only one last blanket or similar cylinder 2 that there would be required only one corresponding web dividing device 11 or 12.

Figure 2:
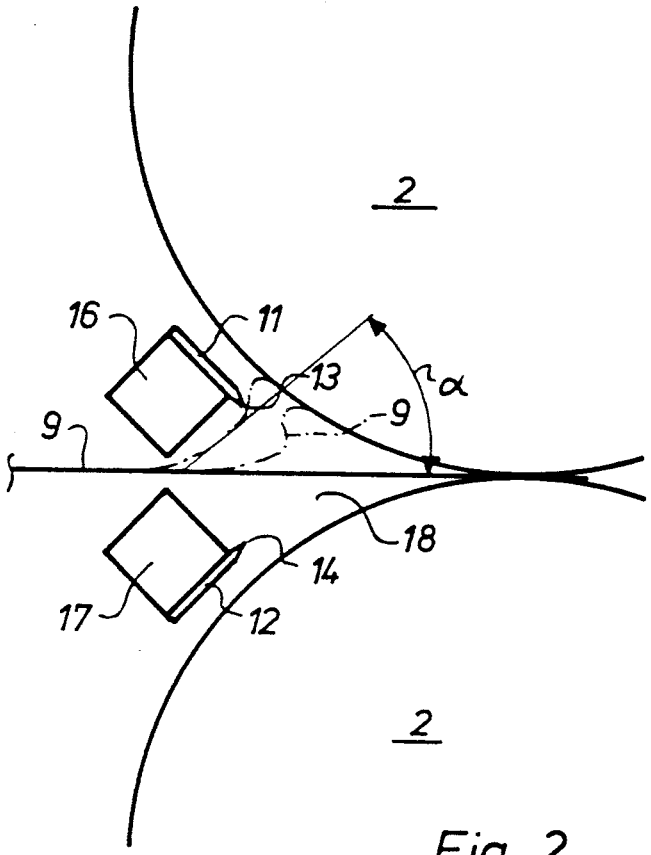
FIG. 2 is a schematic side elevation view of the present invention.

Referring now primarily to FIG. 2, each web dividing device 11 and 12 is in the form of a knife which is positioned generally adjacent the paper web 9. Each such knife 11 or 12 is as wide as the cylinder 2 which it is adjacent to and thus is at least as wide as paper web 9. Each of these knives or web dividing devices 11 or 12 is stationary and is positioned generally parallel to an axis of rotation of each blanket cylinder 2. Each knife 11 or 12 is also fixedly attached to a cross bar 16 or 17 which is supported between the spaced ink frames (not shown) of the printing unit 1. These cross bars 16 and 17 also function as finger guards or finger protection.

As may be seen most clearly in FIG. 2, the planar surfaces of the knives 11 and 12 are arranged generally parallel to, and spaced at a small distance from the surfaces of the blanket cylinders 2. Cutting edge portions 13 and 14 of the knives 11 and 12 jut or extend into a space or area 18 which is adjacent the nip of the two cooperating blanket cylinders 2. This area 18 is further defined by the cross bars 16 and 17. The side plates (not shown) of the web-fed rotary printing machine form lateral or side covers for the space or area 18.

The two cross bars 16 and 17 which carry the knives 11 and 12 are spaced apart from each other at a distance "a", which is sufficiently narrow, such as about 10–30 mm. so that the paper web 9 can pass therebetween while at the same time preventing one of the press operating personnel from being able to insert their fingers into the area 18 adjacent the cutting edges 13 and 14 of the knives or web dividing devices 11 and 12.

Figure 3:
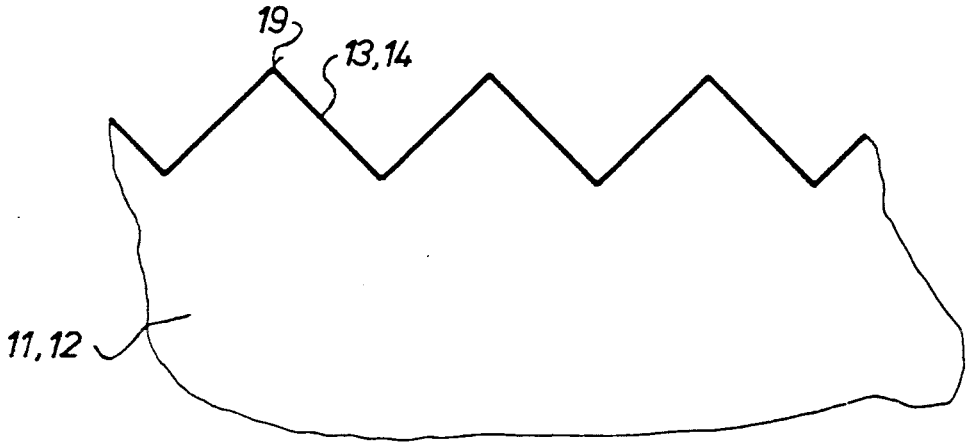
FIG. 3 is a front elevation view of a section of the knife blade of the present invention.

Turning now to FIG. 3, the cutting edges 13 and 14 of the knives 11 and 12 may be seen in detail. These edges 13 and 14 consist of a plurality of peaks 19 and grooves. As such, each cutting edge 13 or 14 of each knife blade 11 or 12 is generally serrated. This edge shape allows the notches or peaks 19 of the cutting edges 13 and 14 of the knives 11 and 12 to safely and efficiently penetrate and divide the paper web 9.

In operation, the paper web 9 is printed in the last printing unit 1 and passes through the dividing devices 11 and 12 of the present invention before it enters the web dryer 6. If the web 9 should break in the dryer 6 or at another point downstream of the last printing unit 1, the web 9 will lose tension. As discussed previously, the loss of web tension will allow the web 9 to stick or adhere to the surface of the upper or lower blanket cylinder 2. As the blanket cylinder continues to rotate, the now tensionless web 9 will start to wrap up on blanket cylinder 2 as is depicted in dot-dash lines in FIG. 2. However, after only a very short length of paper web 9, such as about 5–10 cm. of paper wraps onto a blanket cylinder 2, the web 9 will encounter the cutting edge 13 of the dividing device 11 and will then be severed. It will be seen that the paper web 9 is deflected from its normal transport direction by an angle *a* of generally about 45° before it contacts the cutting edge 13 or 14 of the dividing device 11 or 12. The use of this dividing device 11 or 12 thus ensures that only a very short length of paper web 9 will wrap back onto the blanket cylinder 2 when the web 9 breaks at a point downstream of the last printing unit 1, such as in the dryer 6.

It will be understood that where there is only one blanket cylinder 2 or similar cylinder about which the paper web 9 can wrap, that there will only be a need to position one dividing device 11 or 12 adjacent that single cylinder. It will further be understood that there will be provided a generally conventional and well-known web severing or dividing assembly which will be located before or upstream of the last printing unit 1. This web dividing assembly will operate in its intended manner to sever the web 9 before it enters the printing unit 1 in response to a break in web 9 downstream of the last printing unit 1. This known dividing device is not the subject of the present application and thus does not need to be discussed in detail.

When a paper web 9 breaks at a point downstream of the last printing unit 1, the dividing devices 11 and 12 of the present invention, in concert with the generally well known web severing apparatus located upstream of the last printing unit will cooperate to limit the amount of the paper web 9 which can become wrapped about the blanket cylinder 2. This amount of paper web 9 is so short that it cannot damage the cylinders 2 or 3 or the bearings of the impression cylinder 4. It will be seen that the dividing devices 11 and 12 of the present invention operate in an effective yet simple manner to prevent damage to the printing machine in the event of a paper web break.

While a full and complete description of an apparatus for the preventing of printing machine damage in accordance with the present invention has been set forth hereinabove, it will be apparent to one of skill in the art that a number of changes in, for example, the size of the cylinders, the number and location of the guide rollers and chill rollers, the type of web dryer used and the like, may be made without departing from the true spirit and scope of the present invention, which is accordingly to be limited only by the following claims.

What is claimed is:

1. A paper web dividing apparatus for the prevention of printing maching damage for a web-fed rotary printing machine having spaced cooperating paper web printing cylinders, said apparatus comprising:

at least a first cross bar positioned adjacent to a peripheral surface of a cylinder of a printing unit which is the last to contact a web passing through a web-fed rotary printing machine, said at least first cross bar being positioned downstream, in the direction of paper web travel, from said last web contacting cylinder and being generally parallel to an axis of rotation of said last web contacting cylinder;

at least a first paper web dividing knife attached to said at least first cross bar, said at least first paper web dividing knife having a planar surface which is arranged generally parallel to, and spaced at a small distance from, said peripheral surface of said last web contacting cylinder;

a cutting edge on said at least first paper web dividing knife, said cutting edge and said planar surface extending generally upstream, in the direction of web travel, toward said web adjacent said last web contacting cylinder and being positioned to divide the paper web which is wrapped back on said cylinder of the printing unit which is the last to contack said web passing through the printing unit.

2. A paper web dividing apparatus in accordance with claim 1 wherein said cutting edge on said at least first paper web dividing knife has spaced peaks and notches.

3. The paper web dividing apparatus of claim 1 further including a second cross bar spaced from said first cross bar, and carrying a second paper web dividing knife having a cutting edge, said first and second cross bars defining a space through which said paper web travels after leaving said last web contacting cylinder, said space between said first and second cross bars being sufficiently narrow to allow said paper web to pass between said first and second cross bars while preventing insertion of a press operator's fingers adjacent said cutting edges of said first and second paper web dividing knives.

* * * * *